United States Patent [19]

Sgroi et al.

[11] Patent Number: 4,494,533

[45] Date of Patent: Jan. 22, 1985

[54] ASYMETRICALLY ADJUSTABLE TRACTION DEVICE

[75] Inventors: Nunzio B. Sgroi, 30830 Janlor Dr., Westlake Village, Calif. 91362; Patrick E. Duffy, Hemet, Calif.

[73] Assignee: Nunzio Sgroi, Camarillo, Calif.

[21] Appl. No.: 366,096

[22] Filed: Apr. 6, 1982

[51] Int. Cl.[3] ..... A61H 1/02

[52] U.S. Cl. ..... 128/75; 272/144

[58] Field of Search ..... 128/24 R, 68, 69, 71, 128/75, 72–74; 272/144–146

[56] References Cited

U.S. PATENT DOCUMENTS

| | | | |
|---|---|---|---|
| 1,582,950 | 5/1926 | Weaver et al. | 128/72 |
| 1,750,745 | 3/1929 | Anderson | 272/142 |
| 3,302,641 | 2/1967 | Berne et al. | 128/71 |
| 3,593,708 | 8/1971 | Steele | 128/75 |
| 3,662,750 | 5/1972 | Jorgensen | 128/75 |
| 4,077,403 | 3/1978 | Steele | 128/75 |
| 4,398,713 | 8/1963 | Ellis | 272/145 |

*Primary Examiner*—Richard J. Apley
*Assistant Examiner*—David J. Brown
*Attorney, Agent, or Firm*—Koppel & Harris

[57] ABSTRACT

A traction device for providing relief to the spinal column in which a person is suspended from the midsection over a pair of support pads. The angular position of each support pad is independently adjustable, thereby enabling the stretching effect of the traction device to be specifically tailored for the particular injury being treated. A control mechanism for adjusting and locking the angular position of each pad, and a pad with a generally saddle-shaped profile is described.

9 Claims, 8 Drawing Figures

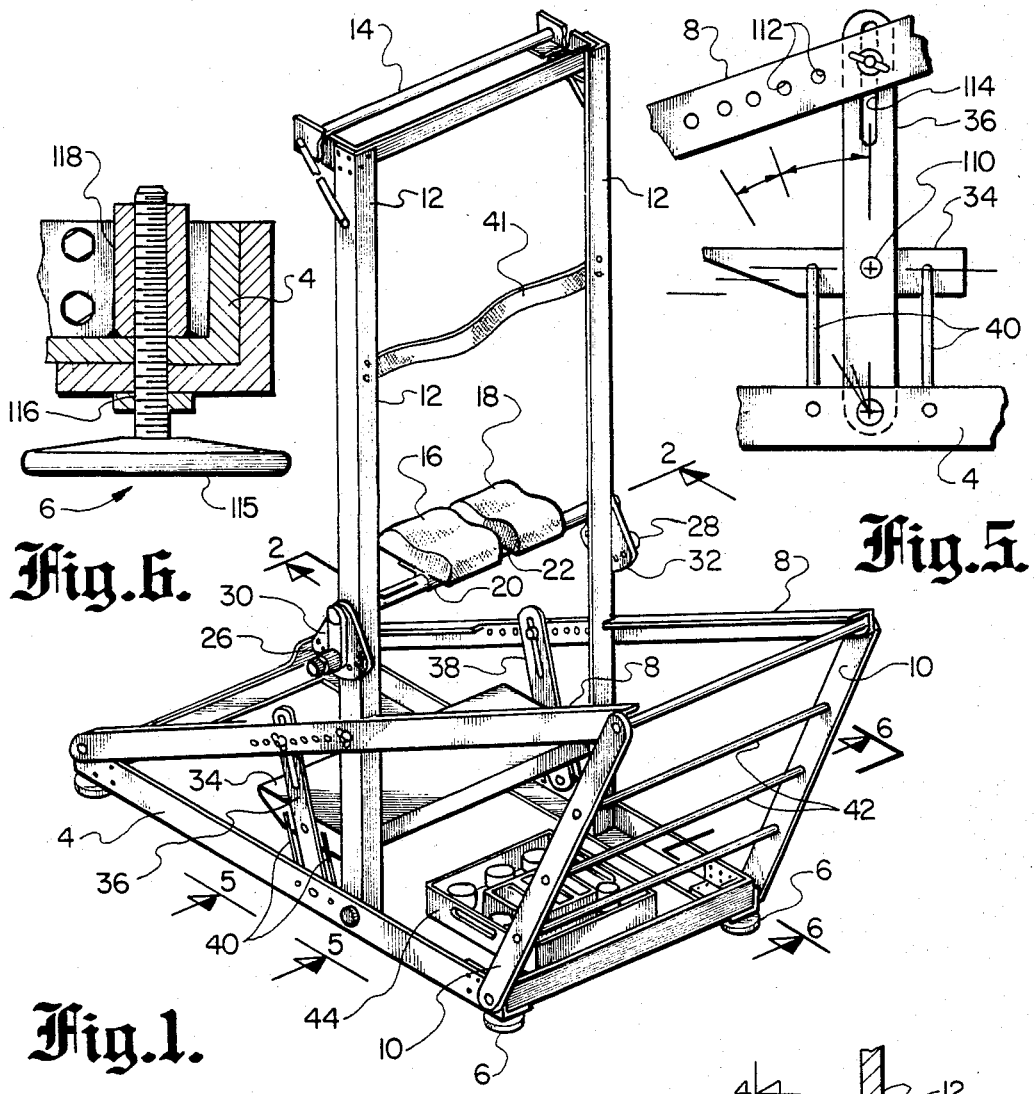
Fig.1.
Fig.5.
Fig.6.
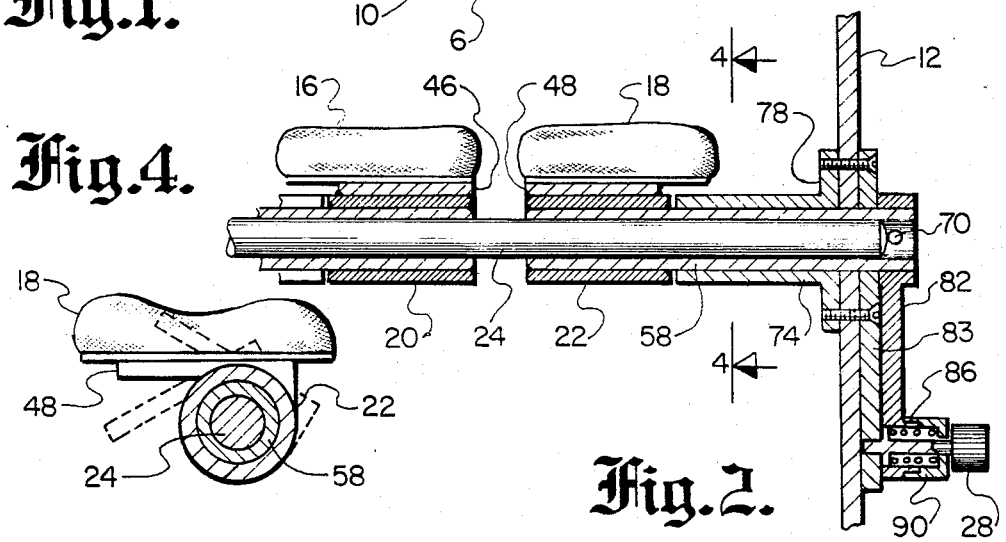
Fig.4.
Fig.2.

ASYMETRICALLY ADJUSTABLE TRACTION DEVICE

BACKGROUND OF THE INVENTION

1. Field of the Invention

This invention relates to traction devices, and more particularly to traction devices of the type in which a person is suspended from the midsection in order to stretch the spinal area.

2. Description of the Prior Art

Various conditions can result in painful lesions forming on the side of the spine. These conditions, such as deteriorated or bulging disks, inflammed disks, spondylothesis and spinal muscular spasms, have been at least partially relieved by traction devices in which the patient is suspended from his midsection over a padded type of trapeze. The weight of the patient's torso, plus any weights he may carry in his hands, tends to stretch the spinal column and provide some relief.

In one prior art device, disclosed in U.S. Pat. No. 3,593,708 to Victor Steele issued July 20, 1971, a pair of square or rectangular body support blocks are mounted on a trapeze-type bar. The blocks are rotatable on the bar, allowing them to be rotated ninety degrees to a vertical position when a person's thighs are brought into contact with them. The person then swings his body over the bar until his feet engage a supporting mechanism and the upper portion of his body hangs vertically downward. In effecting this movement the blocks are rotated under the weight of the person's body until they are generally parallel with the floor.

A variation of this prior art device, built as a portable frame for mounting in a doorway, is disclosed in U.S. Pat. No. 4,077,403, also to Victor Steele, issued Mar. 7, 1978. In this device the support blocks are cylindrical rather than flat, and again are rotatably mounted on a support bar.

While the above prior art devices do provide some relief for various back conditions, it has been found that they do not provide the maximum relief possible. While their body support blocks are rotatable about the trapeze bar, this rotational capability is utilized only to assist the patient in reaching a final hanging position after mounting. The ultimate angular position of the blocks is determined as a matter of patient comfort, and does not take into account the position that will have the optimum theraputic effect. More specifically, spinal lesions can be relieved by activating the sacrum pump to force spinal fluid up and down the spine. The above prior art devices, however, do not fully activate the sacrum pump, leaving room for improvment in the relief which they provide.

SUMMARY OF THE INVENTION

In view of the above problems associated with the prior art, it is an object of this invention to provide a novel and improved traction device for providing relief for various spinal conditions.

Another object is the provision of a novel and improved traction device of the body suspension type in which a pair of body support pads can be independently locked at different positions, thereby providing a greater activation of the sacrum pump for persons suspended by their midsection over the pads.

Another object is the provision of such a device in which the body support pads are independently adjustable by independent locking mechanisms which are simple and easy to use.

In the achievement of these and other objects of the invention a traction device, of the type having an upstanding frame and a body support means carried on the frame for suspending a person from the midsection region, is provided with first and second body support members having non-circular contoured surfaces for receiving and supporting the left and right sides of a person's midsection. The body support members are mounted on the frame generally adjacent to each other and elevated sufficiently for a person to be suspended over the members with the left and right sides of the midsection respectively supported on the first and second members. Means are provided for independently adjusting and locking the angular orientations of the first and second body support members, thereby permitting the amount of stretch imparted to the left and right sides of the body to be independently controlled. The angular orientation for each support member to provide the greatest relief and maximum activation of the sacrum pump can then be selected by the physician or chiropractor, depending upon the patient's particular condition.

In a particular embodiment of the invention, first and second sleeve members carrying first and second body support pads are rotatably carried on a generally horizontal shaft. Each sleeve is provided with a handle for rotating the sleeve until its associated pad, which preferably has a generally saddle-shaped profile, reaches a desired angle. The pad is retained at that angle by a locking means which comprises a plate mounted to the frame adjacent the handle and having a plurality of spaced openings therein, and a spring loaded pin carried by the handle and urged under spring pressure into a plate opening as it is rotated into alignment with the opening by rotation of the handle. The pin is provided with a hand grip at its outer end for retracting it from a plate opening, thereby enabling the pad to be rotated to a different position.

These and other features of the invention will be apparent to those skilled in the art from the following detailed description of a preferred embodiment, taken together with the accompanying drawings in which:

DESCRIPTION OF THE DRAWINGS

FIG. 1 is a perspective view of the traction device of the invention;

FIG. 2 is a section view of the pad adjustment mechanism taken along lone 2—2 of FIG. 1;

FIG. 4 is a section view of a body support pad and its mounting mechanism taken along the line 4—4 of FIG. 2;

FIG. 5 is an elevation view of a mounting platform for the traction device taken along line 5—5 of FIG. 1;

FIG. 6 is a cut-away section view of a leveling mechanism for the traction device;

DETAILED DESCRIPTION OF A PREFERRED EMBODIMENT

Figure 3:
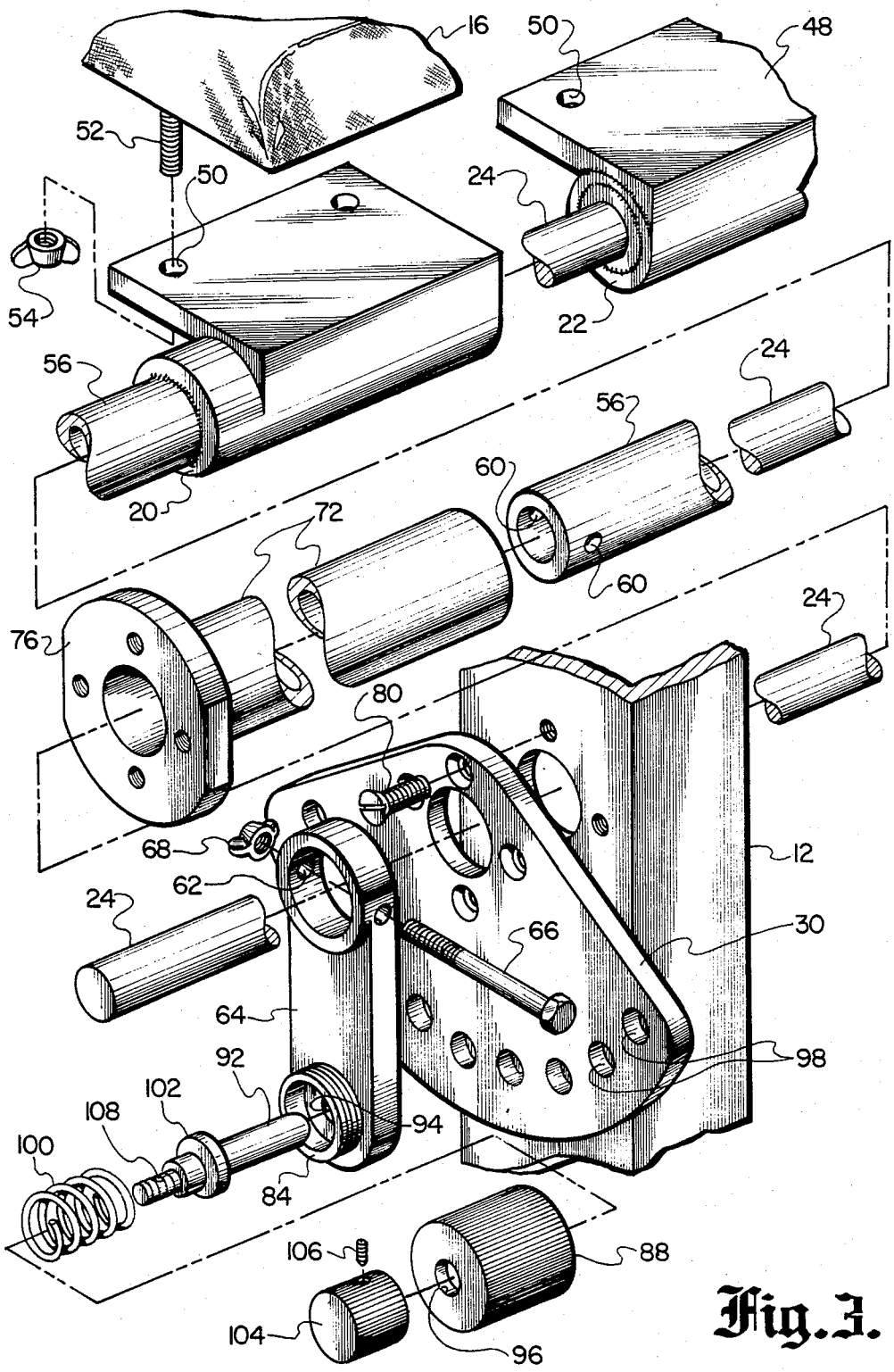
FIG. 3 is an exploded perspective view of the support and adjustment mechanism for the pads.

Referring to FIG. 1, a traction device constructed in accordance with the invention is shown. The principal load bearing elements of the frame 2 are formed by interconnected angle irons. Four angle irons are bolted together to form a rectangular base 4, with an adjustable foot 6 at each corner which serve as leveling mechanisms. Beams 8 extend diagonally forward and upward from each rear corner, and connect slightly forward of the front of the base with shorter beams 10 which extend upwards from the front corners of the base. A pair of vertical support beams 12 extend upwardly from an intermediate portion of the base, and are bolted to diagonal beams 8 at their intersection with those beams for additional support. A chin up bar 14 is preferrably mounted to the upper end of vertical beams 12.

In accordance with the invention, a pair of independently adjustable body support members in the form of shaped pads 16 and 18 are respectively mounted on rotatable sleeves 20 and 22, which in turn are fitted over a shaft 24 (shown in FIG. 2) which extends between vertical beams 12. Pads 16, 18 are spaced apart by a distance sufficient for them to rotate independently of each other on their respective sleeves, and to support the right and left sides of a person's midsection when the person leans over and hangs from the pads.

Sleeves 20, 22 can be rotated about shaft 24 by means of cranks 26, 28 on the outside of beams 12. Rotational control plates 30, 32 are mounted to the outer sides of beams 12 between the beams and cranks 26, 28 respectively. Each plate has a series of openings into which a spring loaded pin in its associated crank is inserted as the crank is rotated into alignment with a selected opening, locking the crank and its support pad in place at that position. The angular orientations of support pads 16, 18 are thus independently adjustable by rotating their respective cranks 26, 28, and each support pad can be locked in place at an angular position corresponding to any one of the openings on its respective locking plate.

If the patient has sustained an injury which affects one side of the spinal column more than the other, the support pad for that side of the body can be locked at an angular position which is different from the angular position of the other support pad, thereby stretching the injured and non-injured sides of the body by different amounts. Under the advice of a qualified doctor or chiropractor, the angular positions of the two support pads can be set so as to maximize the activation of the sacrum pump for the particular injury which has been sustained. This in turn enhances the flow of spinal fluid up and down the spine, thereby providing greater relief to spinal lesions than can be accomplished in prior art devices which do not provide for independent adjustments of left and right support pads. Of course, while a crank and pin hole locking mechanism is disclosed, any other convenient means for independently rotating pads 16 and 18 and locking them at various angular positions could be employed. For example, a steering wheel type of rotation control could be used, together with a locking mechanism that gripped the periphery of collars 20, 22 at any desired angular positions.

The traction apparatus also includes a step-up platform 34 which can be adjusted in height to assist the patient in reaching pads 16, 18 with his midsection. Platform 34 is pivotally carried on support arms 36, 38, the upper ends of which can be connected to various positions along diagonal frame beams 8 so as to adjust the platform's height. A pair of rods 40 are pivotally connected between base 4 and platform 34 on opposite sides of arm 36 at one end of the platform; another pair of rods are similarly connected at the opposite end of the platform 34. The rods serve to hold the platform horizontal as its height is adjusted, while a strap 41 is attached to vertical beams 12 to hold the patient's legs.

At the front end of the traction apparatus a series of rungs 42 are mounted between front frame beams 10 to assist a patient in reaching from a hanging position over the support pads and thereafter dismounting. A weight tray 44 is also shown which can be grasped by the patient as he is hanging to increase the stretching effect on the spinal column.

FIGS. 2 and 3 show details of the pad mounting and adjustment apparatus. Left and right hand pad supporting sleeves 22 and 24 are formed integrally with pad mounting plates 46 and 48, respectively. Each mounting plate has an array of openings 50 which are aligned with corresponding fastening bolts 52 extending down from the underside of the pads. The pads are mounted on their respective mounting plates by inserting the fastening bolts through the openings and tightening wing nuts 54 or the like onto each fastening bolt.

Sleeves 20, 22 are respectively welded to and form an integral construction with hollow pipes 56, 58. These pipes extend from the pads back through openings in vertical support beams 12. The outer ends of pipes 56, 58 each have a pair of diametrically opposed bolt holes 60 which mate with an aligned pair of bolt holes 62 in the crank arm 64 (shown in FIG. 3). A threaded bolt 66 is inserted through openings 60 and 62 and fastened by wing nut 68 to hold the pipe in place. A similar fastening mechanism is provided for pipe 58 by fastening bolt 70. Bolts 66 and 70 also serve to trap shaft 24 between them.

To provide additional strength, collars 72, 74 are fitted respectively over pipes 56, 58. Each collar terminates in a flange 76, 78 which abuts against the inside wall of its respective support beam 12. Rotational control plates 30, 32 are secured in place on the outer walls of beams 12 by screws 80 which extend through aligned openings in the control plates and vertical beams to screw into threaded openings in flanges 76, 78.

The left and right hand crank handles 64, 82 have threaded rings 84, 86 respectively at their lower ends. Hollow inside threaded cups 88, 90 screw over rings 84, 86 to provide convenient grips for turning the crank handles. Housed within cup 88 is a pin 92, the forward end of which extends through an opening 94 in the crank handle, and the rear end of which extends through an opening 96 in the rear of cup 88. A series of spaced openings 98 are provided in rotational control plate 30 in alignment with pin 92 along the arc traversed during rotation of the crank handle to receive the forward end of the pin. A coil spring 100 is positioned around the pin and held in place between the rear wall of cup 88 and a collar 102 on the pin urging the pin forward to lodge in a plate opening 98. A pin gripping member 104 is attached to the end of the pin rearward of cup 88 by means of a small screw 106 which extends through an opening in the gripping member and is screwed into a threaded opening 108 at the end of the pin. The pin can be dislodged from a control plate opening 98 by pulling back on member 104, thereby enabling the crank and pad to be rotated to another position at which the pin is released and moved forward under the influence of coil spring 100 to lodge in another control plate opening thus locking the pad at a new angular orientation.

A similar crank adjustment mechanism is provided on the right hand side of the device, as shown in FIG. 2. It should be noted that pads 16 and 18 and their associated rotational controls are completely separated, thus permitting either pad to be independently rotated to any desired position as determined by the position of its associated crank. In FIG. 4 three different angular positions of pad 18 and its associated mounting plate are shown.

A mechanism for adjusting and leveling step-up platform 34 is shown in FIG. 5. One end of the platform is shown in this figure; a similar support mechanism for the platform is provided at its opposite end. The platform is pivotally carried on arm 34 by means of a pin 110 which extends from the end of the platform into an opening in arm 36, allowing the platform to pivot about the pin. The lower end of arm 36 is pivotally attached to base 4. Its upper end is connected to diagonal beam 8 by means of a fastening screw which extends through one of a series of openings 112 in the beam and a slot 114 in the arm, and is fastened in place by a wing nut. The height of the platform is adjusted by rotating arm 36 and securing its upper end to a different opening 112 in beam 8. The platform is maintained in a horizontal position despite the pivoting of arm 36 by means of the pair of rods 40, which are positioned on each side of arm 36 and are pivotally connected at their opposite ends to platform 34 and base 4.

Details of the leveling mechanism 6 at each corner of the base are shown in FIG. 6. The base of the traction device is supported on a pod 114 which has a flat underside and a threaded shaft 116 extending vertically upward. Shaft 116 is screwed into an inside threaded tube 118 on base 4. The height of the traction device at that corner is simply adjusted by rotating pod 114 and its associated shaft into or out of tube 118.

Figure 7:
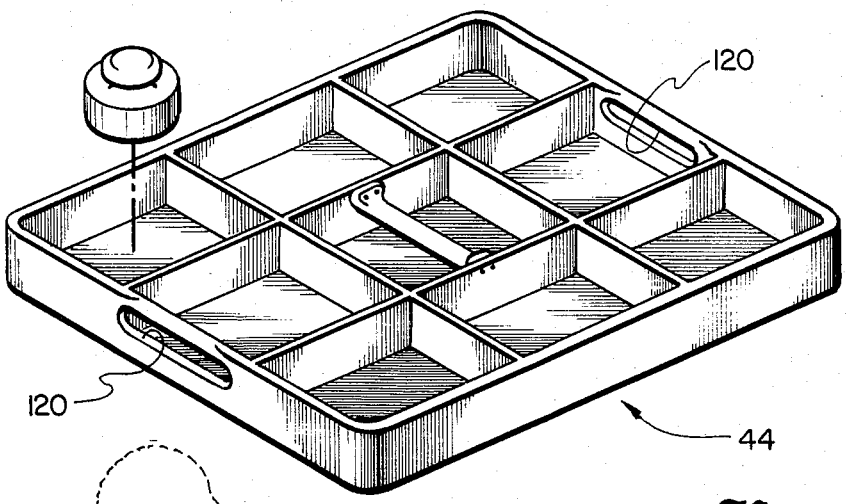
FIG. 7 is a perspective view of a weight tray which may be used with the traction device.

The weight tray 44 is shown in FIG. 7. It is divided into a series of compartments, each of which is suitable for holding weights. A pair of openings 120 are provided to enable the tray to be gripped and lifted by a person hanging from the traction device.

Figure 8:
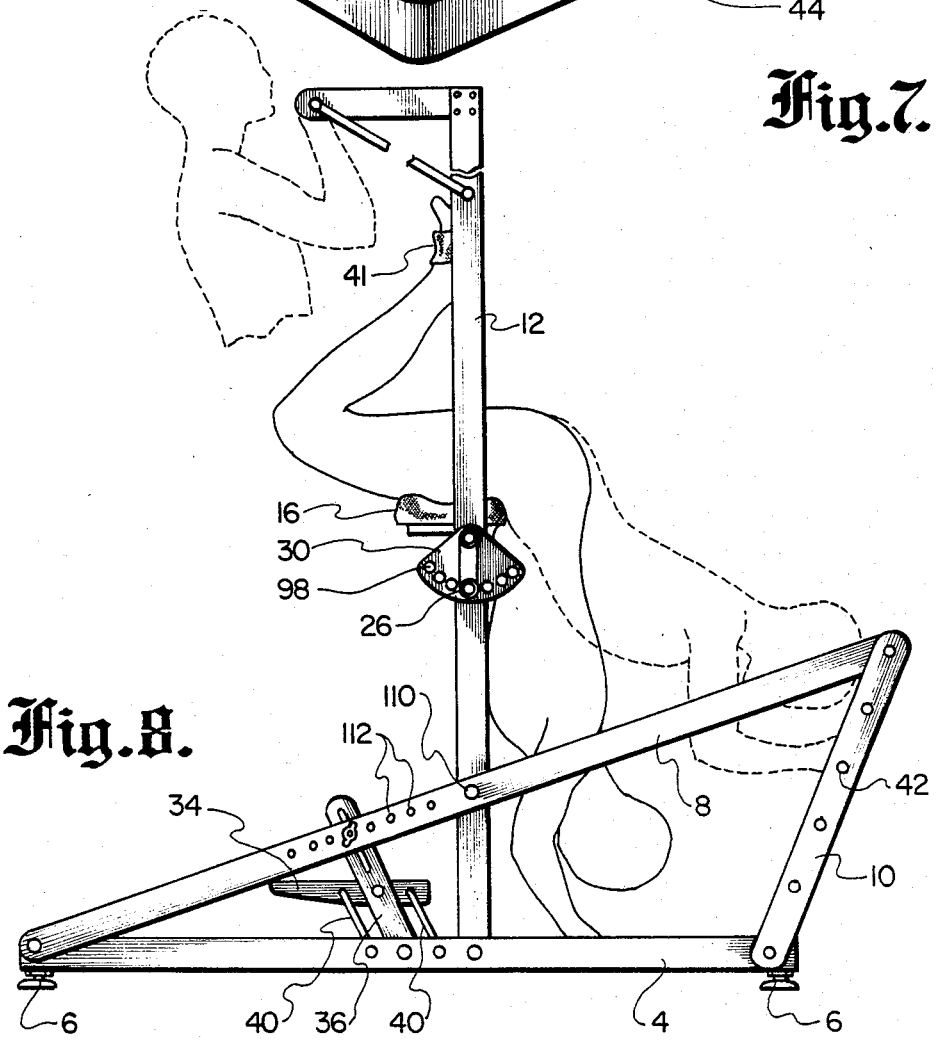
FIG. 8 is a perspective view of a person using the traction device.

The use of the traction device is illustrated in FIG. 8. Initially, each of the cranks 26, 28 is secured at a desired angular position by inserting its respective locking pin into an appropriate opening in control plates 30, 32, thereby locking each of the support pads 16, 18 at desired angular positions. The position of each pad is determined by the type of injury the person has suffered; in general, injuries on one side of the spinal column are treated by positioning the pad on that side to produce a greater stretching effect on that side of the body than on the other side.

The patient then leans over with his midsection on the support pads until he is hanging down with his weight supported by the pads. If desired he can use the rungs at the forward end of the traction device to assist in reaching a hanging position. His feet are also lifted and supported by strap 41 for added support.

The patient hangs in this position for several minutes, as recommended by his doctor or chiropractor. For greater stretching effect he can hold the weight tray as he hangs. After the period is over the patient uses the rungs to lift himself up to a position at which he can dismount.

An embodiment of a traction device in which a pair of support pads are independently adjustable to enhance the therapeutic effect has thus been shown and described. Various modifications and alternate embodiments will occur to those skilled in the art. For example, many different kinds of rotational adjustments for the pads other than the crank handle shown, and many ways of supporting the pads, may be envisioned. Accordingly, it is intended that the invention be limited only in terms of the appended claims.

We claim:

1. A traction device of the type having an upstanding frame and a body support means carried on the frame for suspending a person from the midsection region in order to stretch the spinal column, the improvement comprising:

first and second body support members having noncircular contoured surfaces for receiving the left and right sides of a person's midsection region, respectively, means for mounting said body support members to said frame generally adjacent each other and elevated sufficiently for a person to be suspended over said members with the left and right sides of the midsection respectively supported on the first and second members, and said means for mounting comprises first and second rotational members respectively mounting the first and second body support members, the angular orientation of the body support members being determined by the rotational position of their respective rotational members, and means for independently adjusting the angular orientations of said first and second body support members about the same general horizontal axis, whereby the amount of stretch imparted to the left and right sides of the body may be independently controlled.

2. The traction device of claim 1, wherein said adjusting means comprises first and second rotational controls for independently controlling the rotational positions of the first and second rotational members, respectively.

3. The traction device of claims 1 or 2, further comprising means for releasably locking the adjusting means for the first and second body support members at any one of a plurality of predetermined settings for each member corresponding to a similar plurality of predetermined angular orientations for each of said members.

4. The traction device of claim 3, wherein said locking means comprises first and second independently operated locking means for said first and second body support members, respectively.

5. A traction device of the type having an upstanding frame and a body support means carried on the frame for suspending a person from the midsection region in order to stretch the spinal column, the improvement comprising:

first and second sleeve members respectively carrying first and second body support pads, a generally horizontal shaft extending axially through said sleeve members and mounted to the frame, the sleeve members being rotationally supported on said shaft with their pads positioned to respectively support the left and right sides of a person's midsection, and first and second control means respectively engaging the first and second sleeve members, each of said control means being adjustable to adjust the rotational position of its respective sleeve member, whereby the amount of stretch imparted to the left and right sides of a person suspended over the pads may be separately controlled by adjusting said control means.

6. The traction device of claim 5, each of said control means comprising a handle connected to and extending outwardly from its respective sleeve, to provide a mechanical rotating advantage, and means for releasably locking said handle at any one of a plurality of rotational positions.

7. The traction device of claim 6, the locking means for each handle comprising a plate mounted to the frame adjacent the handle and having a plurality of spaced openings therein, and a spring loaded pin carried by the handle and urged under spring pressure into each opening as it is rotated into alignment with said opening by rotation of the handle.

8. The traction device of claim 7, each handle carrying an outwardly extending housing, the spring loaded pin extending through the housing, and a hand grip attached to the end of the pin exterior to the housing for retracting the pin from the plate openings.

9. The traction device of claims 1 or 5, said body support members having a generally saddle-shaped profile for supporting a person's body.

* * * * *